US005102246A

United States Patent [19]

Patz

[11] Patent Number: 5,102,246

[45] Date of Patent: Apr. 7, 1992

[54] PERFORATED END REMOVAL APPARATUS

[76] Inventor: David J. Patz, 8250 E. Golf Links, Apt. 229, Tucson, Ariz. 85730

[21] Appl. No.: 715,612

[22] Filed: Jun. 14, 1991

[51] Int. Cl.[5] ..... B41J 11/68

[52] U.S. Cl. ..... 400/621.1; 83/435.1

[58] Field of Search ..... 400/621.1; 83/423, 435.1; 225/96.5

[56] References Cited

U.S. PATENT DOCUMENTS 4,940,347 7/1990 Lund ..... 400/621.1

4,993,856 2/1991 Chung ..... 400/621.1

FOREIGN PATENT DOCUMENTS 0241251 10/1962 Australia ..... 400/621.1

0197186 3/1982 Japan ..... 400/621.1

*Primary Examiner*—Edgar S. Burr

*Assistant Examiner*—Lynn D. Hendrickson

*Attorney, Agent, or Firm*—Leon Gilden

[57] ABSTRACT

An apparatus arranged for mounting upon a delivery system to effect removal of side edge portions of a web, wherein the apparatus includes a plurality of "U" shaped housings, wherein each housing includes a feed slot therethrough, each feed slot arranged in confronting relationship relative to one another secured together by a support link, with a roller mounted overlying the feed roller of the web to effect rotation of a cutting disk mounted within each slot to effect removal of side edges of the web.

4 Claims, 4 Drawing Sheets

PERFORATED END REMOVAL APPARATUS

BACKGROUND OF THE INVENTION

1. Field of the Invention

The field of invention relates to edge removal apparatus, and more particularly pertains to a new and improved perforated end removal apparatus wherein the same effects removal of perforated end portions of a sheet web typically utilized in printing press organizations.

2. Description of the Prior Art

The severing and removal of perforated end portions of a sheet web typically involved bulky and awkward equipment associated with drive rollers. U.S. Pat. No. 3,729,123 to Lloyd sets forth a prior art printing machine wherein a sheet web is fed therethrough, of typical configuration as utilized in the prior art.

U.S. Pat. No. 4,722,275 to Taguchi, et al. sets forth a rotary press structure setting forth web feeding, as utilized in the prior art.

U.S. Pat. No. 4,726,293 to Ende sets forth a roller organization utilized with a sheet web, wherein the roller is arranged to prevent wrinkling of a web utilizing perforated side edges.

U.S. Pat. No. 4,846,060 to Proctor sets forth a further example of a prior art web feed structure utilized in a printing organization.

As such, it may be appreciated that there continues to be a need for a new and improved perforated end removal apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of edge removal apparatus now present in the prior art, the present invention provides a perforated end removal apparatus wherein the same utilizes rotary cutting disk mounted within respective confronting "U" shaped housings to sever and remove perforated end portions of a sheet web fed therethrough. As such, the general purpose of the present invention, which will be described subsequently in greater detail, is to provide a new and improved perforated end removal apparatus which has all the advantages of the prior art web cutting apparatus and none of the disadvantages.

To attain this, the present invention provides an apparatus arranged for mounting upon a delivery system to effect removal of side edge portions of a web, wherein the apparatus includes a plurality of "U" shaped housings, wherein each housing includes a feed slot therethrough, each feed slot arranged in confronting relationship relative to one another secured together by a support link, with a roller mounted overlying the feed roller of the web to effect rotation of a cutting disk mounted within each slot to effect removal of side edges of the web.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved perforated end removal apparatus which has all the advantages of the prior art web removal apparatus and none of the disadvantages.

It is another object of the present invention to provide a new and improved perforated end removal apparatus which may be easily and efficiently manufactured and marketed.

It is a further object of the present invention to provide a new and improved perforated end removal apparatus which is of a durable and reliable construction.

An even further object of the present invention is to provide a new and improved perforated end removal apparatus which is susceptible of a low cost of manufacture with regard to both materials and labor, and which accordingly is then susceptible of low prices of sale to the consuming public, thereby making such perforated end removal apparatus economically available to the buying public.

Still yet another object of the present invention is to provide a new and improved perforated end removal apparatus which provides in the apparatuses and methods of the prior art some of the advantages thereof, while simultaneously overcoming some of the disadvantages normally associated therewith.

Still another object of the present invention is to provide a new and improved perforated end removal apparatus wherein the same is readily retrofitted overlying a printing feed roll of an associated printing press organization to effect severing and removal of perforated side edge portions of a web fed through opposed "U" shaped housings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
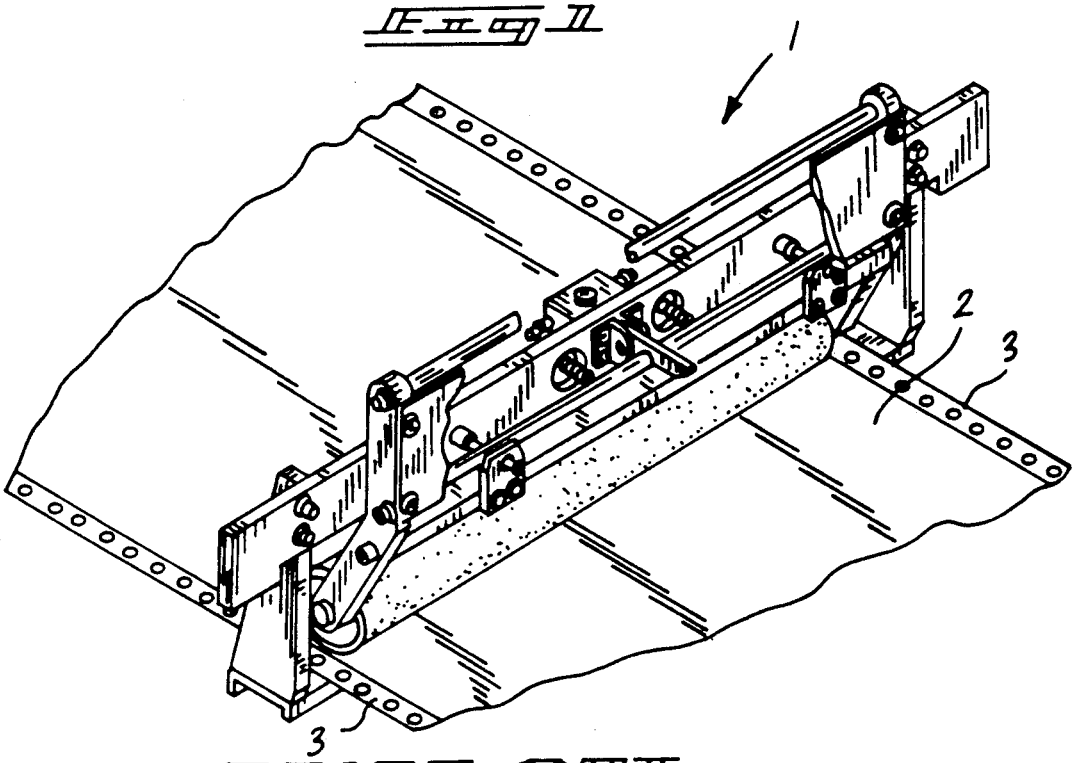
FIG. 1 is an isometric illustration of a prior art web apparatus, as typically utilized by the prior art.
Figure 3:
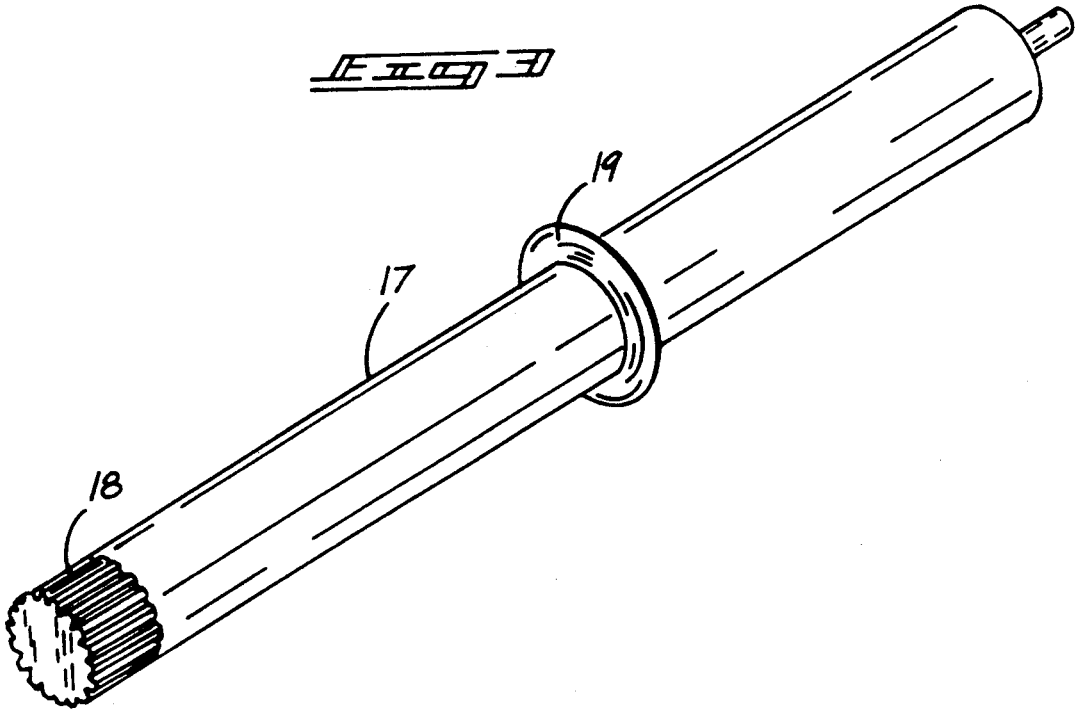
PRIOR ART FIG 3
FIG. 3 is an isometric illustration of the cutting shaft utilized by the instant invention.
Figure 2:
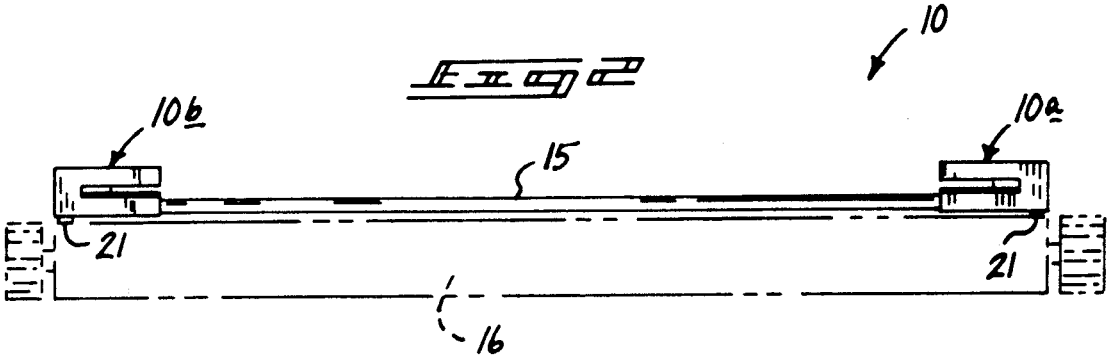
FIG. 2 is an orthographic side view, taken in elevation, of the instant invention.
Figure 4:
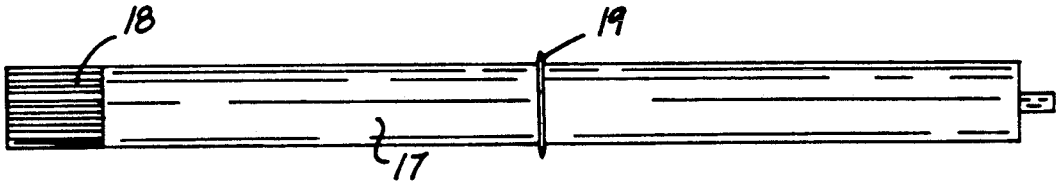
FIG. 4 is an orthographic side view, taken in elevation, of the instant invention.
Figure 5:
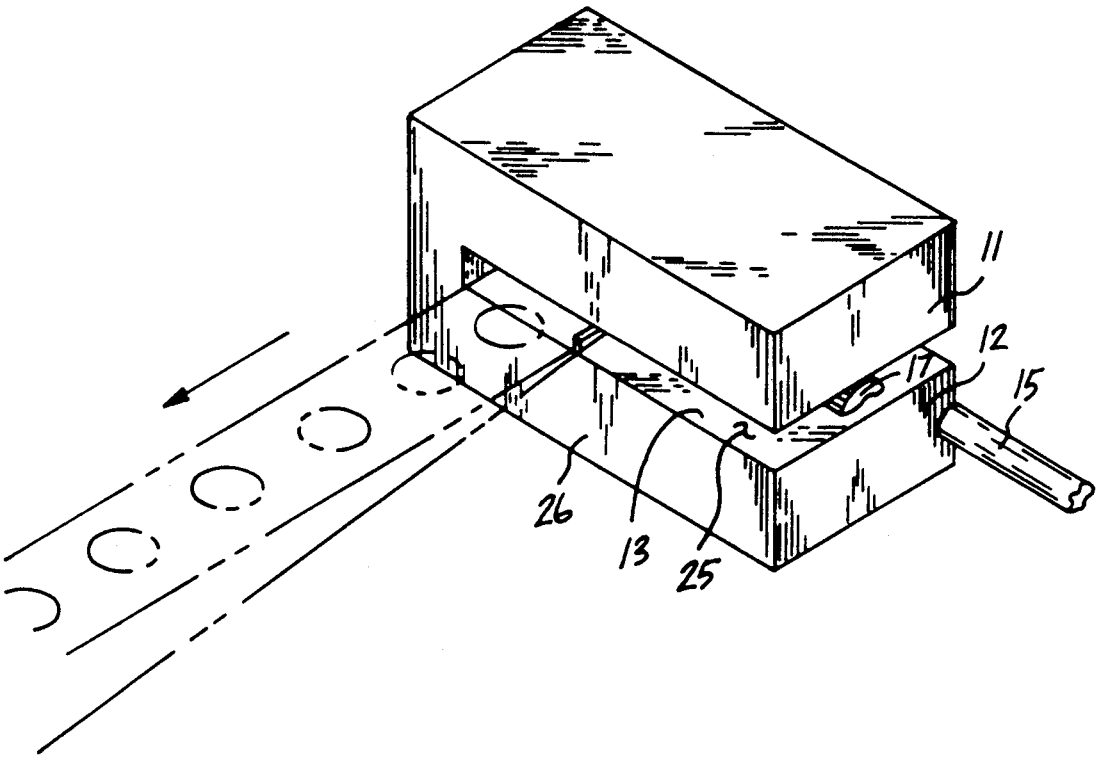
FIG. 5 is an isometric illustration of one of the plurality of "U" shaped housings utilized by the instant invention.
Figure 6:
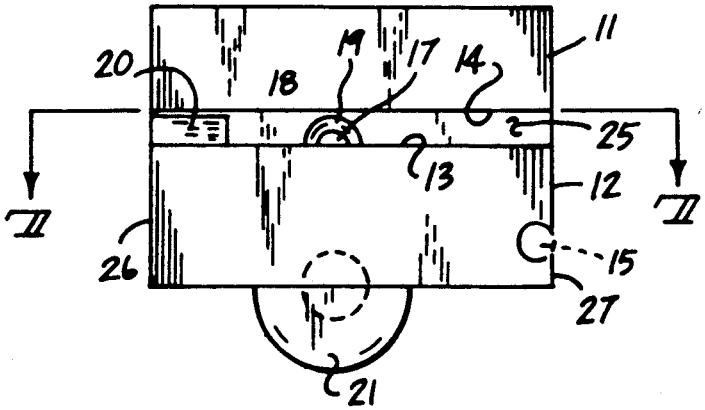
FIG. 6 is an orthographic end view, taken in elevation, of the "U" shaped housing as set forth in FIG. 5.
Figure 7:
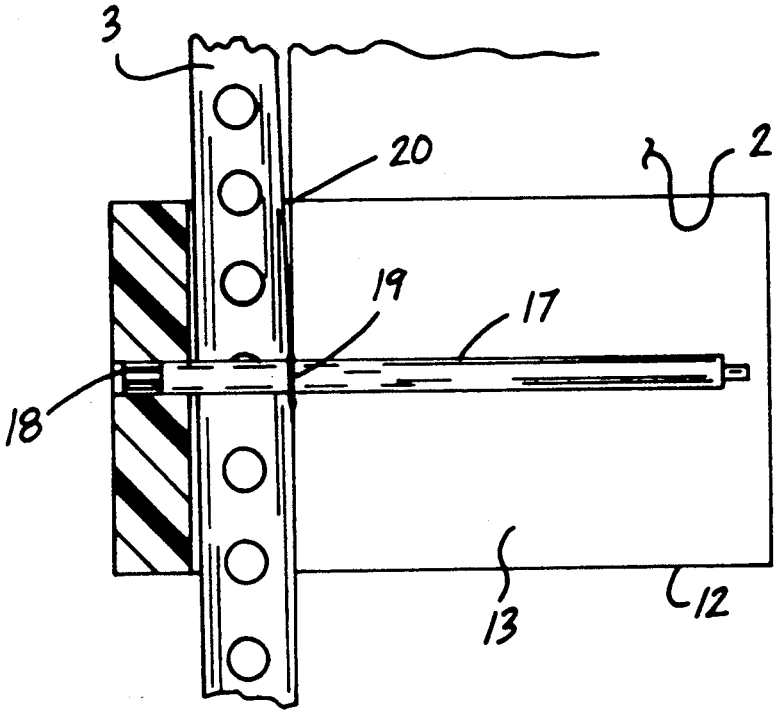
FIG. 7 is an orthographic, taken along the lines 7—7 of FIG. 6 in the direction indicated by the arrows.

With reference now to the drawings, and in particular to FIGS. 1 to 8 thereof, a new and improved perforated end removal apparatus embodying the principles and concepts of the present invention and generally designated by the reference numeral 10 will be described.

FIG. 1 illustrates a prior art web feed organization 1, as utilized with a conventional printing press, wherein a sheet web 2 utilizing spaced perforated side portions 3 are directed therethrough, in a manner as set forth in U.S. Pat. No. 4,726,293.

More specifically, the perforated end removal apparatus 10 of the instant invention essentially comprises a plurality of "U" shaped housings defining a right and left respective housing 10*a* and 10*b* (see FIG. 2), with each housing formed as a mirror image configuration relative to one another and joined together by a paper bail or interconnecting link 15. The housings each include a feed slot 25 defined between a housing top leg 11 and a housing bottom leg 12. As the housings are of a mirror image configuration, where understandably the other housing is of identical configuration.

The interconnecting link 15 is orthogonally mounted between each right and left housing 10*a* and 10*b* mounted contiguous the bottom leg rear face 27 thereof to enhance guidance of the web 2 into each feed slot 25 of each housing. A feed roller 16, as illustrated in phantom in FIG. 2, mounts the confronting "U" shaped housings together, wherein each housing includes a drive roller 21 to effect rotation of the drive rollers upon rotation of the feed roller 16. The drive roller 21 is cooperative with an intermediate gear 22 (see FIG. 8), which in turn effects rotation of a cutting shaft drive gear 18 of an associated cutting shaft 17, with the cutting shaft 17 orthogonally mounting the cutter disk 19 which rotatably and operatively rotates within the feed slot 25 longitudinally relative to orientation of the web feed of the web to be fed through each slot 25. A separating wedge 20 is orthogonally mounted on the housing bottom leg top surface 13 adjacent the bottom leg forward face 26 aligned with the cutting disk 19 that is fixedly mounted on the cutting shaft 17. A compression spring 24 biasingly mounts the top gear 23 to accommodate shock to the gear system, as illustrated in FIG. 8, as the drive roller 21 rotatably is mounted on the feed roller 16.

Figure 8B:
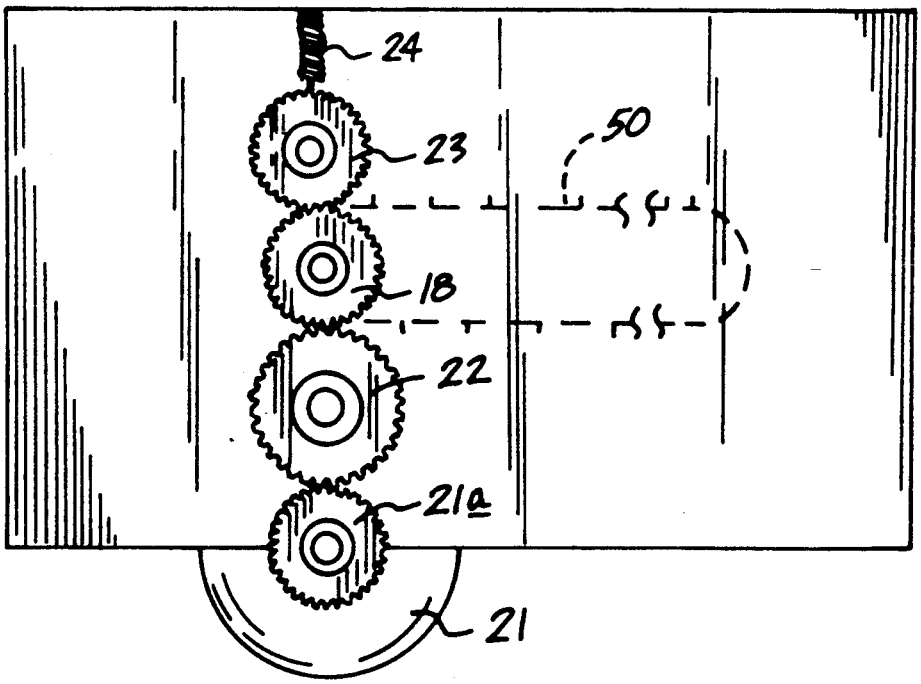
FIG. 8 is an orthographic side view, taken in section, of the gear drive train utilized by the instant invention.

Further it should be noted, as depicted in FIG. 8, that a track feed organization 50 utilizing spaced pin members therefrom are spaced by predetermined spacing equal to a spacing defined by the apertures within the perforated side portions 3 of a conventional sheet web 2. This track feed may be utilized to enhance and maintain feeding of the sheet web through the "U" shaped housings, as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A perforated end removal apparatus in combination with a feed roller, wherein the feed roller is rotatably mounted to direct a sheet web thereover, the sheet web including side edge portions, and the feed roller including a right and left end portion, and a respective right and left "U" shaped housing positioned overlying the right and left end portions of the feed roller, and an interconnecting link mounted between the right and left "U" shaped housings to position the right and left housings relative to one another, and each housing including a drive roller, each drive roller in rolling communication with the feed roller, the drive rollers including a drive roller gear, a cutting shaft gear contained within the housing, and the drive roller gear in operative association with the cutting shaft gear, wherein the cutting shaft gear is orthogonally mounted relative to an elongate cutting shaft, the cutting shaft is mounted within each "U" shaped housing, each "U" shaped housing including a slot, and each slot receiving the sheet web therethrough, and each cutting shaft including a cutting disk positioned within each slot and each cutting disk being orthogonally oriented relative to the cutting shaft.

2. An apparatus as set forth in claim 1 wherein each "U" shaped housing includes a top leg and a bottom leg, the bottom leg including a bottom leg top surface, the bottom leg top surface including a separating wedge fixedly mounted thereto, the separating wedge positioned adjacent a forward face of the bottom leg and orthogonally mounted to the bottom leg top surface, with the separating wedge longitudinally aligned with the cutting disk.

3. An apparatus as set forth in claim 2 wherein each "U" shaped housing includes a bottom leg rear face and the interconnecting link is positioned adjacent to and longitudinally aligned relative to each bottom leg rear face of each "U" shaped housing adjacent the bottom leg top surface to provide a guide surface for the sheet web directed through each slot of each "U" shaped housing.

4. An apparatus as set forth in claim 3 wherein the cutting shaft gear is operatively associated with a top gear, wherein the top gear includes a compression spring to bias the top gear against the cutting shaft gear to maintain operative association with the cutting shaft gear with the drive gear to provide shock accommodating mounting of the cutting shaft gear relative to the drive gear.

* * * * *